US007031913B1

(12) United States Patent
Murashima

(10) Patent No.: US 7,031,913 B1
(45) Date of Patent: Apr. 18, 2006

(54) METHOD AND APPARATUS FOR DECODING SPEECH SIGNAL

(75) Inventor: Atsushi Murashima, Tokyo (JP)

(73) Assignee: NEC Corporation, Tokyo (JP)

( * ) Notice: Subject to any disclaimer, the term of this patent is extended or adjusted under 35 U.S.C. 154(b) by 557 days.

(21) Appl. No.: 09/658,045

(22) Filed: Sep. 8, 2000

(30) Foreign Application Priority Data

Sep. 10, 1999 (JP) ..... 11-257075

(51) Int. Cl.
*G10L 19/04* (2006.01)
*G10L 19/14* (2006.01)

(52) U.S. Cl. ..... 704/219; 704/223; 704/224

(58) Field of Classification Search ..... 704/211, 704/215, 221, 223, 224, 225, 226, 227, 228, 704/219
See application file for complete search history.

(56) References Cited

U.S. PATENT DOCUMENTS 6,415,253 B1 * 7/2002 Johnson ..... 704/210
6,453,289 B1 * 9/2002 Ertem et al. ..... 704/225
6,606,593 B1 * 8/2003 Jarvinen et al. ..... 704/223
6,735,567 B1 * 5/2004 Gao et al. ..... 704/258
6,757,650 B1 * 6/2004 Yasunaga et al. ..... 704/223
6,772,115 B1 * 8/2004 Yasunaga et al. ..... 704/223
6,910,008 B1 * 6/2005 Yasunaga et al. ..... 704/223
6,947,889 B1 * 9/2005 Yasunaga et al. ..... 704/223

* cited by examiner

*Primary Examiner*—Martin Lerner
(74) *Attorney, Agent, or Firm*—Dickstein, Shapiro, Morin & Oshinsky, LLP.

(57) ABSTRACT

A method of decoding a speech signal based on a CELP (Code Excited Linear Prediction) with improvement in degradation of decoded sound quality in a noise period. The method includes the steps of: calculating a norm of an excitation vector for each fixed period in a noise period; smoothing the calculated norm using a norm obtained in a previous period; changing the amplitude of the excitation vector in the period using the calculated norm and the smoothed norm; and driving a synthesizing filter by the excitation vector with the changed amplitude.

20 Claims, 9 Drawing Sheets

METHOD AND APPARATUS FOR DECODING SPEECH SIGNAL

BACKGROUND OF THE INVENTION

1. Field of the Invention

The present invention relates generally to a coding and decoding technique for transmitting speech signals at a low bit rate, and more particularly to a decoding method and a decoding apparatus for improving sound quality in an environment where noise exists.

2. Description of the Prior Art

Methods of coding a speech signal by separating the speech signal to a linear prediction filter and its driving excitation signal (also referred to as excitation signal or excitation vector) are widely used as a method of efficiently coding a speech signal at an intermediate or low bit rate. One typical method thereof is CELP (Code Excited Linear Prediction). In the CELP, an excitation signal (excitation vector) drives a linear prediction filter for which a linear prediction coefficient representing frequency characteristics of input speech is set, thereby obtaining a synthesized speech signal (reproduced speech, reproduced vector). The excitation signal is represented by the sum of a pitch signal (pitch vector) representing a pitch period of speech and a sound source signal (sound source vector) comprising random numbers or pulses. In this case, each of the pitch signal and the sound source signal is multiplied by gain (i.e., pitch gain and sound source gain). For the CELP, reference can be made to M. Schroeder et al., "Code excited linear prediction: High quality speech at very low bit rates", Proc. of IEEE Int. Conf. on Acoust., Speech and Signal processing, pp. 937–940, 1985 (Literature 1).

Mobile communication systems such as a cellular phone system require favorable quality of speech in noisy environments typified by the hustle and bustle in downtown or the inside of a running car. However, speech coding techniques based on the CELP have a problem of significant deterioration of sound quality for speech on which noise is superimposed, that is, speech with background noise. A time period in a speech signal under a noisy environment is referred to as a noise period.

For improving the quality of coded speech from the speech with background noise, a method of smoothing the sound source gain at a decoder has been proposed. In this method, the smoothing of the sound source gain causes a smooth change with time in short time average power of the sound source signal multiplied by the sound source gain, resulting in a smoothed change with time in short time average power of the excitation signal as well. This leads to mitigation of significant variations in short time average power in decoded noise, which is one of factors for degradation, thereby improving the sound quality.

For a method of smoothing gain in the sound source signal, reference can be made, for example, to Section 6.1 of "Digital Cellular Telecommunication System; Adaptive Multi-Rate Speech Transcoding", ETSI Technical Report, GSM 06.90, version 2.0.0 (Literature 2).

FIG. 1 is a block diagram showing an example of a configuration of a conventional speech signal decoding apparatus, and illustrates a technique of improving quality of coding of a speech with background noise by smoothing gain in a sound source signal. Assume herein that bit sequences are inputted at a frame period of $T_{fr}$ (for example, 20 milliseconds), and reproduced vectors are calculated at a subframe period of $(T_{fr}/N_{sfr})$ (for example, 5 milliseconds) where $N_{sfr}$ is an integer number (for example, 4). A frame length is $L_{fr}$ samples (for example, 320 samples), and a subframe length is $L_{sfr}$ samples (for example, 80 samples). These numbers of samples are employed in the case of a sampling frequency of 16 kHz for input signals. Description is hereinafter made for the speech signal decoding apparatus shown in FIG. 1.

Bit sequences of coded data are supplied from input terminal 10. Code input circuit 1010 divides and converts the bit sequences supplied from input terminal 10 to indexes corresponding to a plurality of decoding parameters. Code input circuit 1010 provides an index corresponding to an LSP (Line Spectrum Pair) representing the frequency characteristic of the input signal to LSP decoding circuit 1020, an index corresponding to delay representing the pitch period of the input signal to pitch signal decoding circuit 1210, an index corresponding to a sound source vector including random numbers or pulses to sound source signal decoding circuit 1110, an index corresponding to a first gain to first gain decoding circuit 1220, and an index corresponding to a second gain to second gain decoding circuit 1120.

LSP decoding circuit 1020 contains a table in which plural sets of LSPs are stored. LSP decoding circuit 1020 receives, as its input, the index outputted from code input circuit 1010, reads the LSP corresponding to that index from the table contained therein, and sets the read LSP to LSP: $\hat{q}_j^{(N_{sfr})}(n)$, $j=1, \ldots, N_p$ in $N_{sfr}$th subframe of the current frame (n-th frame), where $N_p$ represents a linear prediction order. The LSPs from the first to $(N_{sfr}-1)$th subframes are derived by linear interpolation of $\hat{q}_j^{(N_{sfr})}(n)$ and $\hat{q}_j^{(N_{sfr})}(n-1)$. LSP decoding circuit 1020 outputs the LSP: $\hat{q}_j^{(m)}(n)$, $j=1, \ldots, N_p$, $m=1, \ldots, N_{sfr}$ to linear prediction coefficient converting circuit 1030 and to smoothing coefficient calculating circuit 1310.

Linear prediction coefficient converting circuit 1030 converts the LSP: $\hat{q}_j^{(m)}(n)$ supplied from LSP decoding circuit 1020 to linear prediction coefficient $\hat{\alpha}_j^{(m)}(n)$, $j=1, \ldots, N_p$, $m=1, \ldots, N_{sfr}$, and outputs it to synthesizing filter 1040. It should be noted that, for the conversion from the LSP to the linear prediction coefficient, known methods can be used, for example the method described in Section 5.2.4 of Literature 2.

Sound source signal decoding circuit 1110 contains a table in which a plurality of sound source vectors are stored. Sound source signal decoding circuit 1110 receives the index outputted from code input circuit 1010, reads the sound source vector corresponding to that index from the table contained therein, and outputs it to second gain circuit 1130.

First gain decoding circuit 1220 includes a table in which a plurality of gains are stored. First gain decoding circuit 1220 receives, as its input, the index outputted from code input circuit 1010, reads the first gain corresponding to that index from the table contained therein, and outputs it to first gain circuit 1230.

Second gain decoding circuit 1120 contains another table in which a plurality of gains are stored. Second gain decoding circuit 1120 receives, as its input, the index from code input circuit 1010, reads the second gain corresponding to that index from the table contained therein, and outputs it to smoothing circuit 1320.

First gain circuit 1230 receives, as its inputs, a first pitch vector, later described, outputted from pitch signal decoding circuit 1210 and the first gain outputted from first gain decoding circuit 1220, multiplies the first pitch vector by the first gain to produce a second pitch vector, and outputs the produced second pitch vector to adder 1050.

Second gain circuit 1130 receives, as its inputs, the first sound source vector from sound source signal decoding circuit 1110 and the second gain, later described, from smoothing circuit 1320, multiplies the first sound source vector by the second gain to produce a second sound source vector, and outputs the produced second sound source vector to adder 1050.

Adder 1050 calculates the sum of the second pitch vector from first gain circuit 1230 and the second sound source vector from second gain circuit 1130 and outputs the result of the addition to synthesizing filter 1040 as an excitation vector.

Storage circuit 1240 receives the excitation vector from adder 1050 and holds it. Storage circuit 1240 outputs the excitation vectors which were previously received and held thereby to pitch signal decoding circuit 1210.

Pitch signal decoding circuit 1210 receives, as its inputs, the previous excitation vectors held in storage circuit 1240 and the index from code input circuit 1010. The index specifies a delay $L_{pd}$. Pitch signal decoding circuit 1210 takes a vector for $L_{sfr}$ samples corresponding to a vector length from the point going back $L_{pd}$ samples from the beginning of the current frame in the previous excitation vectors to produce a first pitch signal (i.e., first pitch vector). When $L_{pd}<L_{sfr}$, a vector for $L_{pd}$ samples is taken, and the taken $L_{pd}$ samples are repeatedly connected to produce a first pitch vector with a vector length of $L_{sfr}$ samples. Pitch signal decoding circuit 1210 outputs the first pitch vector to first gain circuit 1230.

Smoothing coefficient calculating circuit 1310 receives the LSP: $\hat{q}_j^{(m)}(n)$ outputted from LSP decoding circuit 1020, and calculates an average LSP: $\bar{q}_{0j}(n)$ in n-th frame with the following equation:

$$\bar{q}_{0j}(n)=0.84\cdot\bar{q}_{0j}(n-1)+0.16\cdot\hat{q}_j^{(N_{sfr})}(n)$$

Next, smoothing coefficient calculating circuit 1310 calculates a variation $d_0(m)$ of the LSP for each subframe m with the following equation:

$$d_0(m)=\sum_{j=1}^{N_p}\frac{|\bar{q}_{0j}(n)-\hat{q}_j^{(m)}(n)|}{\bar{q}_{0j}(n)}$$

A smoothing coefficient $k_0(m)$ in subframe m is calculated with the following equation:

$$k_0(m)=\min(0.25,\ \max(0,\ d_0(m)-0.4))/0.25$$

where min(x,y) is a function which takes on a smaller one of x and y, while max(x,y) is a function which takes on a larger one of x and y. Finally, smoothing coefficient calculating circuit 1310 outputs the smoothing coefficient $k_0(m)$ to smoothing circuit 1320.

Smoothing circuit 1320 receives, as its inputs, the smoothing coefficient $k_0(m)$ from smoothing coefficient calculating circuit 1310 and the second gain from second gain decoding circuit 1120. Smoothing circuit 1320 calculates an average gain $\bar{g}_0(m)$ from a second gain $\hat{g}_0(m)$ in a subframe m with the following equation:

$$\bar{g}_0(m)=\frac{1}{5}\sum_{i=0}^{4}\hat{g}_0(m-i)$$

Next, the following equation is substituted for the second gain:

$$\hat{g}_0(m)=\hat{g}_0(m)\cdot k_0(m)+\bar{g}_0(m)\cdot(1-k_0(m))$$

Finally, smoothing circuit 1320 outputs the substituted second gain to second gain circuit 1130.

Synthesizing filter 1040 receives, as its inputs, the excitation vector from adder 1050 and the linear prediction coefficient $\hat{\alpha}_j^{(m)}(n)$, j=1, . . . , $N_p$, m=1, . . . $N_{sfr}$ from linear prediction coefficient converting circuit 1030. In synthesizing filter 1040, the excitation vector drives the synthesizing filter (1/A(z)) for which the linear prediction coefficient is set to calculates a reproduced vector which is then outputted from output terminal 20.

The transfer function of synthesizing filter 1040 is represented as follows:

$$\frac{1}{A(z)}=\frac{1}{\left(1-\sum_{i=1}^{N_p}\alpha_i z^i\right)}$$

where the linear prediction coefficient is $\alpha_i$, i=1, . . . , $N_p$.

Next, a conventional speech signal coding apparatus is described. FIG. 2 is a block diagram showing an example of a configuration of a speech signal coding apparatus used in a conventional speech signal coding and decoding system. The speech signal coding apparatus is used in a pair with the speech signal decoding apparatus shown in FIG. 1 such that coded data outputted from the speech signal coding apparatus is transmitted and inputted to the speech signal decoding apparatus shown in FIG. 1. Since the operations of first gain circuit 1230, second gain circuit 1130, adder 1050 and storage circuit 1240 in FIG. 2 are similar to those of the respective corresponding functional blocks described for the speech signal decoding apparatus shown in FIG. 1, the description thereof is not repeated here.

In the apparatus shown in FIG. 2, speech signals are sampled, and a plurality of the resultant samples are formed into one vector as one frame to produce an input signal (input vector) which is then inputted from input terminal 30.

Linear prediction coefficient calculating circuit 5510 performs linear prediction analysis on the input vector supplied from input terminal 30 to derive a linear prediction coefficient. For the linear prediction analysis, reference can be made to known methods, for example, in Section 8 "Linear Predictive Coding of Speech" of "Digital Processing of Speech Signals", L. R. Rabiner et al., Prentice-Hall, 1978 (Literature 3). Linear prediction coefficient calculating circuit 5510 outputs the derived linear prediction coefficient to LSP conversion/quantization circuit 5520.

LSP conversion/quantization circuit 5520 receives the linear prediction coefficient from linear prediction coefficient calculating circuit 5510, converts the linear prediction coefficient to an LSP, quantizes the LSP to derive the quantized LSP. For the conversion from the linear prediction coefficient to the LSP, known methods can be referenced, for example, the method described in Section 5.2.4 of Literature 2. For the quantization of the LSP, the method described in Section 5.2.5 of Literature 2 can be referenced. The quantized LSP is set to a quantized LSP:$\hat{q}_j^{(N_{sfr})}(n)$, j=1, . . . , $N_p$ in $N_{sfr}$th subframe of the current frame (n-th frame), similarly to the LSP in the LSP decoding circuit of the speech signal decoding apparatus shown in FIG. 1. The quantized LSPs from the first to ($N_{sfr}$−1)th subframes are derived by linear interpolation of $\hat{q}_j^{(N_{sfr})}(n)$ and $\hat{q}_j^{(N_{sfr})}(n-1)$. The LSP is set to an LSP in a ($N_{sfr}$−1)th subframe of the current frame (n-th frame). The LSPs from the first to $(N_{sfr}-1)$th subframes are derived by linear interpolation of $q_j^{(N_{sfr})}(n)$ and $q_j^{(N_{sfr})}(n-1)$.

LSP conversion/quantization circuit 5520 outputs the LSP: $q_j^{(m)}(n)$, j=1, . . . , $N_p$, m=1, . . . , $N_{sfr}$ and the quantized LSP: $\hat{q}_j^{(m)}(n)$, j=1, . . . , $N_p$, m=1, . . . , $N_{sfr}$ to linear prediction coefficient converting circuit 5030, and outputs the index corresponding to the quantized LSP: $\hat{q}_j^{(N_{sfr})}(n)$ to code output circuit 6010.

Linear prediction coefficient converting circuit 5030 receives, as its inputs, the LSP: $q_j^{(M)}(n)$ and the quantized LSP: $\hat{q}^{(m)}(n)$ from LSP conversion/quantization circuit 5520, converts the LSP $(q_j^{(m)}(n))$ to a linear prediction coefficient $[\alpha_j^{(m)}(n)$, j=1, . . . , $N_p$, m=1, . . . , $N_{sfr}]$, converts the quantized LSP $(\hat{q}_j^{(m)}(n))$ to a quantized linear prediction coefficient: $\hat{\alpha}_j^{(m)}(n)$, j=1, . . . , $N_p$, m=1, . . . , $N^{sfr}$, outputs the linear prediction coefficient $\alpha_j^{(m)}(n)$ to weighting filter 5050 and to weighting synthesizing filter 5040, and outputs the quantized linear prediction coefficient $\hat{\alpha}_j^{(m)}(n)$ to weighting synthesizing filter 5040. For the conversion from the LSP to the linear prediction coefficient and the conversion from the quantized LSP to the quantized linear prediction coefficient, known methods can be referenced, for example, the method described in Section 5.2.4 of Literature 2.

Weighting filter 5050 receives, at its inputs, the input vector from input terminal 30 and the linear prediction coefficient $\alpha_j^{(m)}(n)$ from linear prediction coefficient converting circuit 5030, uses the linear prediction coefficient to produce a transfer function W(z) of the weighting filter corresponding to human auditory characteristics. The weighting filter is driven by the input vector to obtain a weighted input vector. Weighting filter 5050 outputs the weighted input vector to differentiator 5060. The transfer function W(z) of the weighting filter is represented as follows:

$$W(z)=Q(Z/\gamma_1)/Q(Z/\gamma_2)$$

Here, the followings hold:

$$Q(z/\gamma_1) = 1 - \sum_{i=1}^{N_p} \alpha_i^{(m)} \gamma_1^i z^i$$

$$Q(z/\gamma_2) = 1 - \sum_{i=1}^{N_p} \alpha_i^{(m)} \gamma_2^i z^i$$

$\gamma_1$ and $\gamma_2$ are constants, for example, $\gamma_1$=0.9 and $\gamma_2$=0.6. For details on the weighting filter, Literature 1 can be referenced.

Weighting synthesizing filter 5040 receives, as its inputs, an excitation vector outputted from adder 1050, the linear prediction coefficient $\alpha_j^{(m)}(n)$, and the quantized linear prediction coefficient $\hat{\alpha}_j^{(m)}(n)$ outputted from linear prediction coefficient converting circuit 5030. The weighting synthesizing filter $H(z)W(z)=Q(z/\gamma_1)/[A(z)Q(z/\gamma_2)]$ for which those are set is driven by the excitation vector to obtain a weighted reproduced vector. The transfer function H(z)=1/A(z) of the synthesizing filter is represented as follows:

$$\frac{1}{A(z)} = \frac{1}{\left(1 - \sum_{i=1}^{N_p} \hat{\alpha}_i^{(m)} z^i\right)}$$

Differentiator 5060 receives, as its inputs, the weighted input vector from weighting filter 5050 and the weighted reproduced vector from weighting synthesizing filter 5040, and calculates and outputs the difference between them as a difference vector to minimization circuit 5070.

Minimization circuit 5070 sequentially outputs indexes corresponding to all sound source vectors stored in sound source signal producing circuit 5110 to sound source signal producing circuit 5110, indexes corresponding to all delays $L_{pd}$ within a specified range in pitch signal producing circuit 5210 to pitch signal producing circuit 5210, indexes corresponding to all first gains stored in first gain producing circuit 6220 to first gain producing circuit 6220, and indexes corresponding to all second gains stored in second gain producing circuit 6120 to second gain producing circuit 6120. Minimization circuit 5070 also calculates the norm of the difference vector outputted from differentiator 5060, selects the sound source vector, delay, first gain and second gain which lead to a minimized norm, and outputs the indexes corresponding to the selected values to code output circuit 6010.

Each of pitch signal producing circuit 5210, sound source signal producing circuit 5110, first gain producing circuit 6220 and second gain producing circuit 6120 sequentially receives the indexes outputted from minimization circuit 5070. Since each of these pitch signal producing circuit 5210, sound source signal producing circuit 5110, first gain producing circuit 6220 and second gain producing circuit 6120 is the same as the counterpart of pitch signal decoding circuit 1210, sound source signal decoding circuit 1110, first gain decoding circuit 1220 and second gain decoding circuit 1120 shown in FIG. 1 except the connections for input and output, the detailed description of each of these blocks is not repeated.

Code output circuit 6010 receives the index corresponding to the quantized LSP outputted from LSP conversion/quantization circuit 5520, receives the indexes each corresponding to the sound source vector, delay, first gain and second gain outputted from minimization circuit 5070, converts each of the indexes to a code of bit sequences, and outputs it through output terminal 40.

The aforementioned conventional decoding apparatus and coding and decoding system have a problem of insufficient improvement in degradation of decoded sound quality in a noise period since the smoothing of the sound source gain (second gain) in the noise period fails to cause a sufficiently smooth change with time in short time average power calculated from the excitation vector. This is because the smoothing only of the sound source gain does not necessarily sufficiently smooth the short time average power of the excitation vector which is derived by adding the sound source vector (the second sound source vector after the gain multiplication) to a pitch vector (the second pitch vector after the gain multiplication).

FIG. 3 shows short time average power of an excitation signal (excitation vector) when sound source gain smoothing is performed in a noise period on the basis of the aforementioned prior art. FIG. 4 shows short time average power of an excitation signal when such smoothing is not performed. In each of these graphs, the horizontal axis represent a frame number, while the vertical axis represents power. The short time average power is calculated every 80 msec. It can be seen from FIG. 3 and FIG. 4 that, when the sound source gain is smoothed according to the prior art, the short time average power in the excitation signal after the smoothing is not necessarily smoothed sufficiently in terms of time.

SUMMARY OF THE INVENTION

It is an object of the present invention to provide a decoding method and a coding and decoding method with improved degradation of decoded sound quality in a noise period.

It is another object of the present invention to provide a decoding apparatus and a coding and decoding system with improved degradation of decoded sound quality in a noise period.

The first object of the present invention is achieved by a method of decoding a speech signal by decoding information on an excitation signal and information on a linear prediction coefficient from a received signal, producing the excitation signal and the linear prediction coefficient from the decoded information, and driving a filter configured with the linear prediction coefficient by the excitation signal, the method comprising the steps of: calculating a norm of the excitation signal for each fixed period; smoothing the calculated norm using a norm obtained in a previous period; changing the amplitude of the excitation signal in the period using the calculated norm and the smoothed norm; and driving the filter by the excitation signal with the changed amplitude.

The second object of the present invention is achieved by an apparatus for decoding a speech signal by decoding information on an excitation signal and information on a linear prediction coefficient from a received signal, producing the excitation signal and the linear prediction coefficient from the decoded information, and driving a filter configured with the linear prediction coefficient by the excitation signal, the apparatus comprising: an excitation signal normalizing circuit for calculating a norm of the excitation signal for each fixed period and dividing the excitation signal by the norm; a smoothing circuit for smoothing the norm using a norm obtained in a previous period; and an excitation signal restoring circuit for multiplying the excitation signal by the smoothed norm to change the amplitude of the excitation signal in the period.

In the present invention, the excitation signal is typically an excitation vector.

In the present invention, since smoothing is performed in a noise period on the norm calculated from the excitation vector obtained by adding a sound source vector (a second sound source vector after gain multiplication) to a pitch vector (a second pitch vector after gain multiplication), short time average power is smoothed in terms of time in the excitation vector. Therefore, improvement can be obtained in degradation of decoded sound quality in a noise period.

In the present invention, the smoothing may be performed on the norm derived from the excitation vector by selectively using a plurality of processing methods provided in consideration of the characteristic of an input signal, not by using single processing. The provided processing methods include, for example, moving average processing which performs calculations from decoding parameters in a limited previous period, auto-regressive processing which can consider the effect of a long past period, or non-linear processing which limits a preset value with upper and lower limits after calculation of an average.

The above and other objects, features, and advantages of the present invention will be apparent from the following description referring to the accompanying drawings which illustrate an example of a preferred embodiment of the present invention.

DESCRIPTION OF THE PREFERRED EMBODIMENTS

Figure 2:
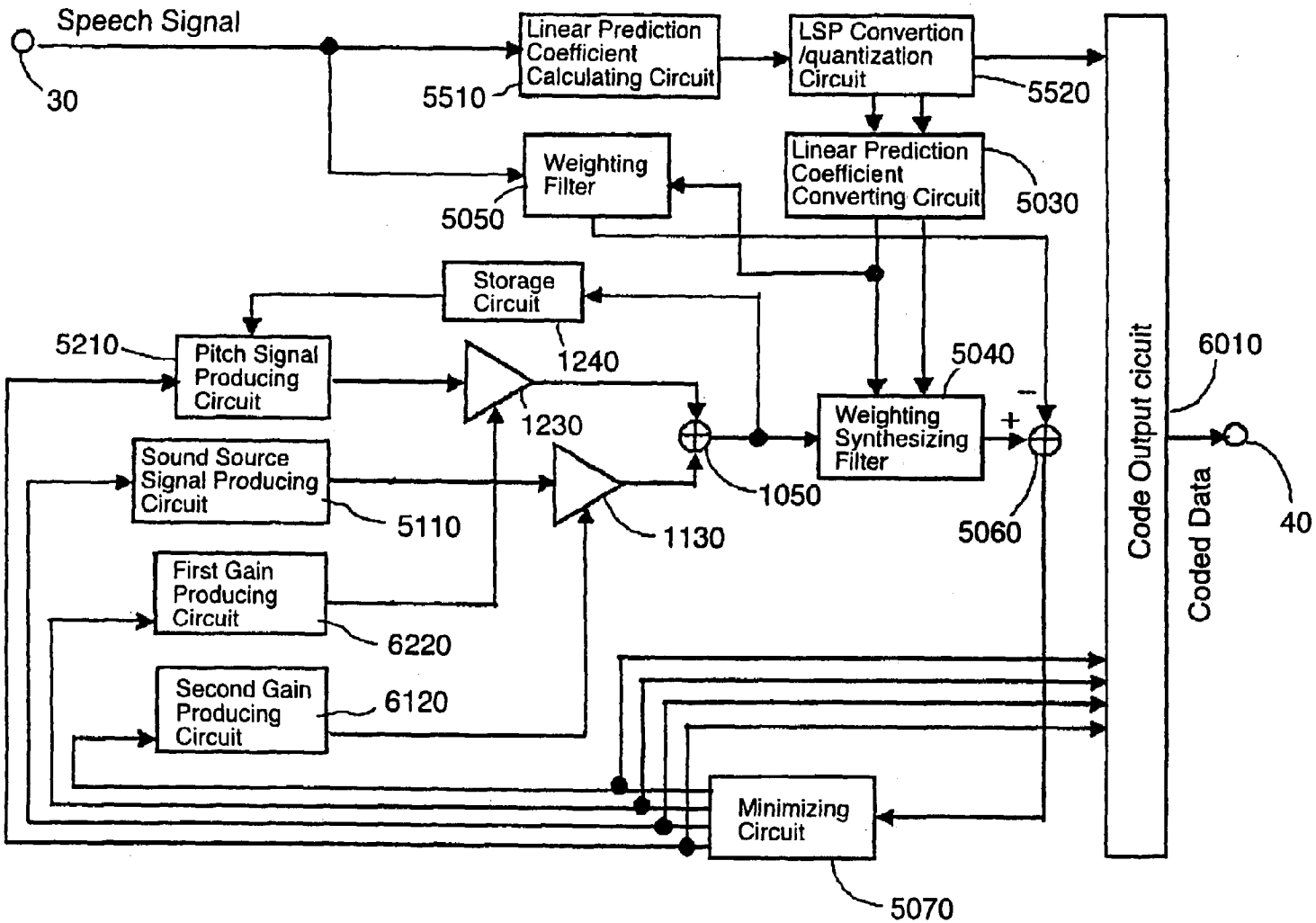
FIG. 2 (PRIOR ART)
FIG. 2 is a block diagram showing an example of a configuration of a conventional speech signal coding apparatus.
Figure 3:
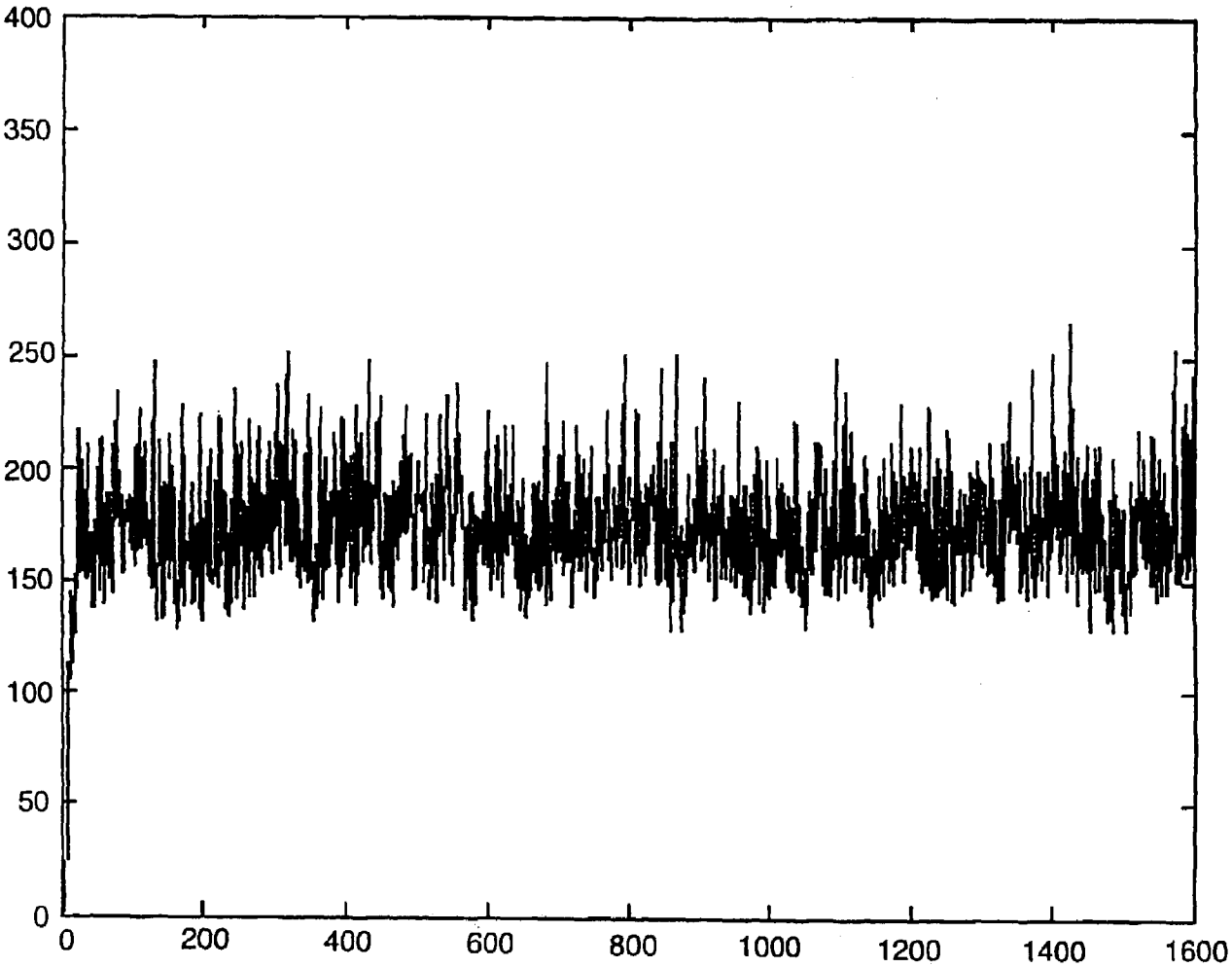
FIG. 3 (PRIOR ART)
FIG. 3 is a graph representing short time average power of an excitation signal (excitation vector) for which smoothing of sound source gain was performed on the basis of a conventional method.
Figure 4:
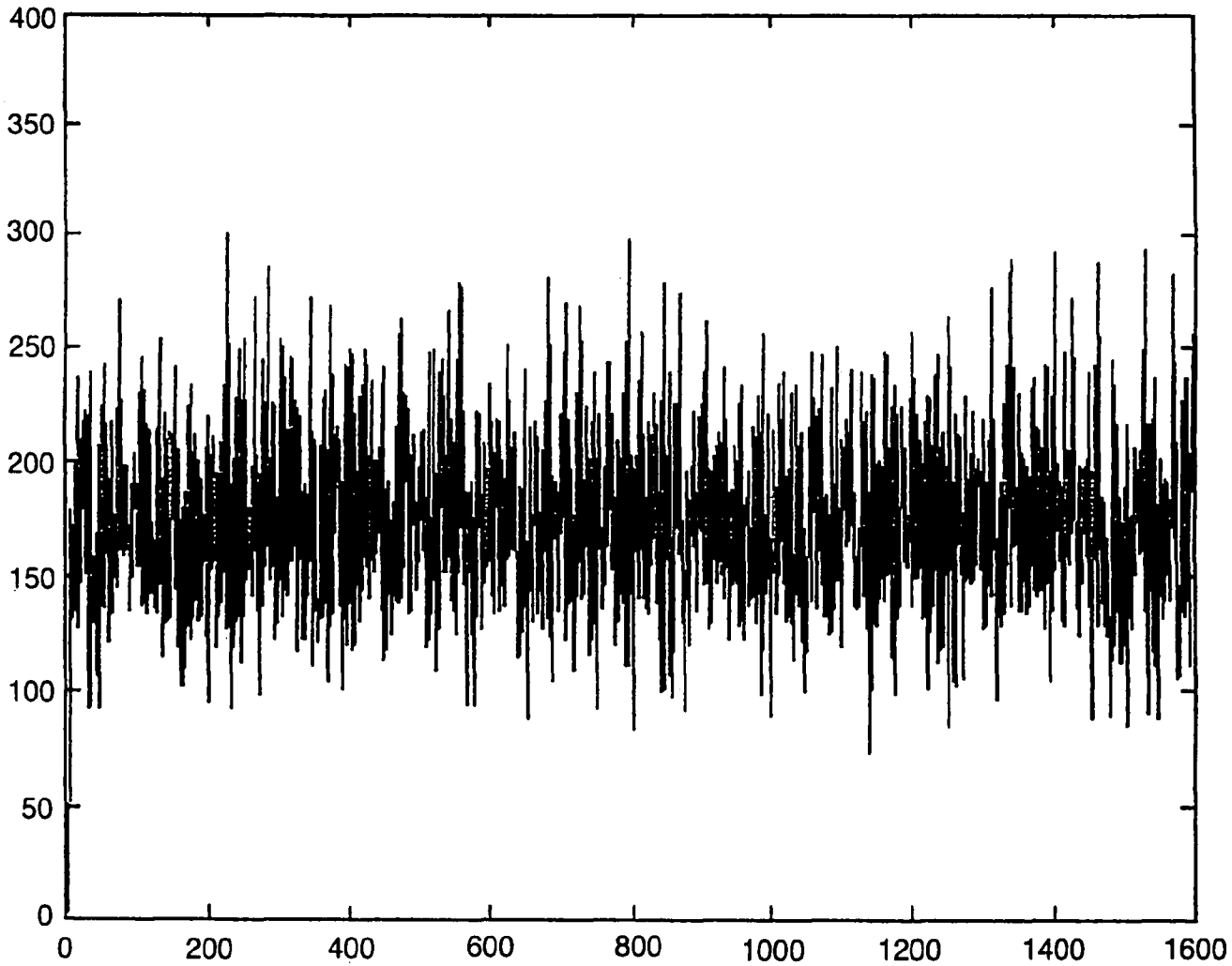
FIG. 4 (PRIOR ART)
FIG. 4 is a graph representing short time average power of an excitation signal (excitation vector) for which smoothing was not performed.
Figure 5:
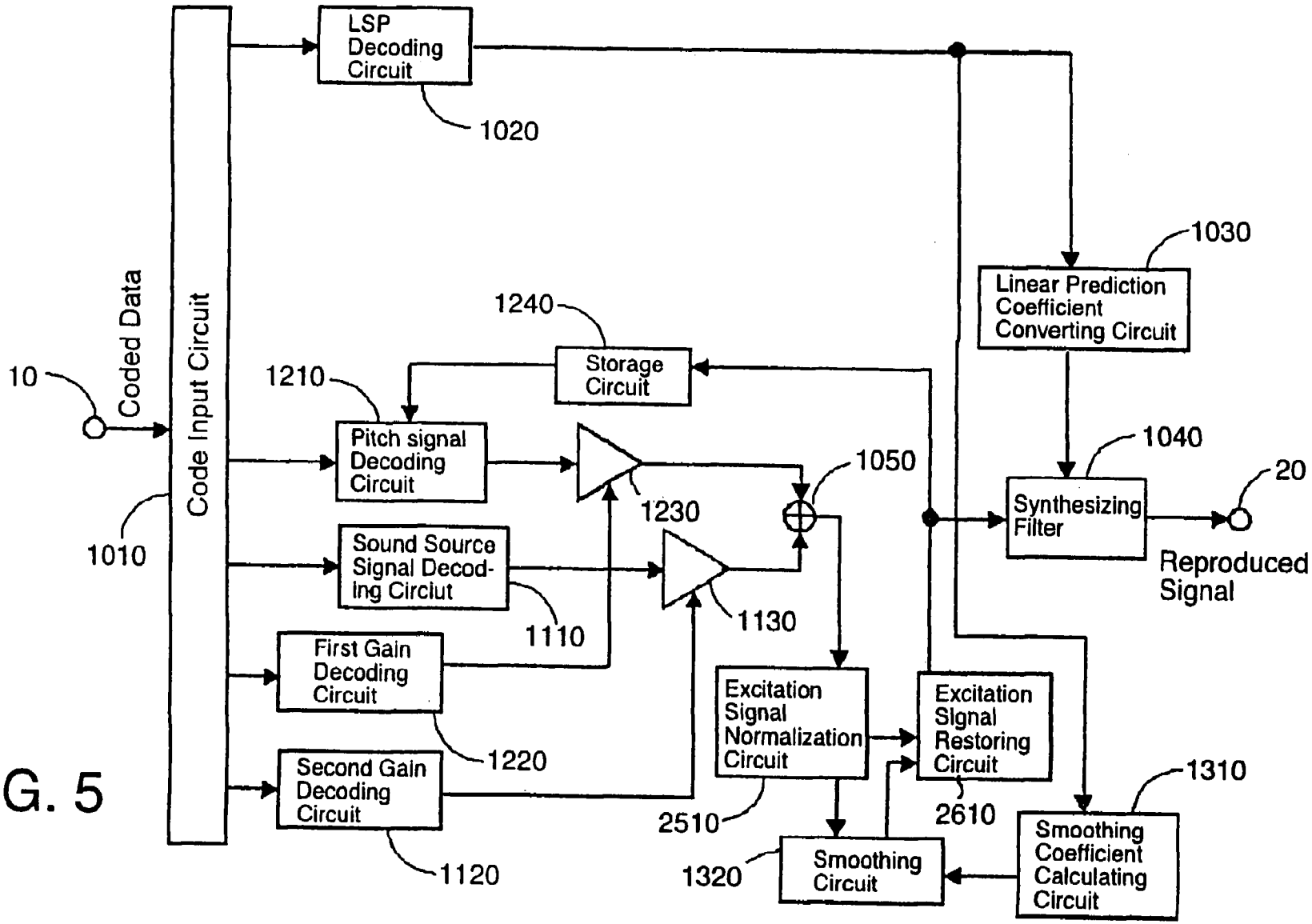
FIG. 5 is a block diagram showing a configuration of a speech signal decoding apparatus based on a first embodiment of the present invention.

A speech signal decoding apparatus of a first embodiment of the present invention shown in FIG. 5 forms a pair with the conventional speech signal coding apparatus shown in FIG. 2 to constitute a speech signal coding and decoding system, and is configured to receive, as its input, coded data outputted from the speech signal coding apparatus shown in FIG. 2 to perform decoding of the coded data.

Figure 1:
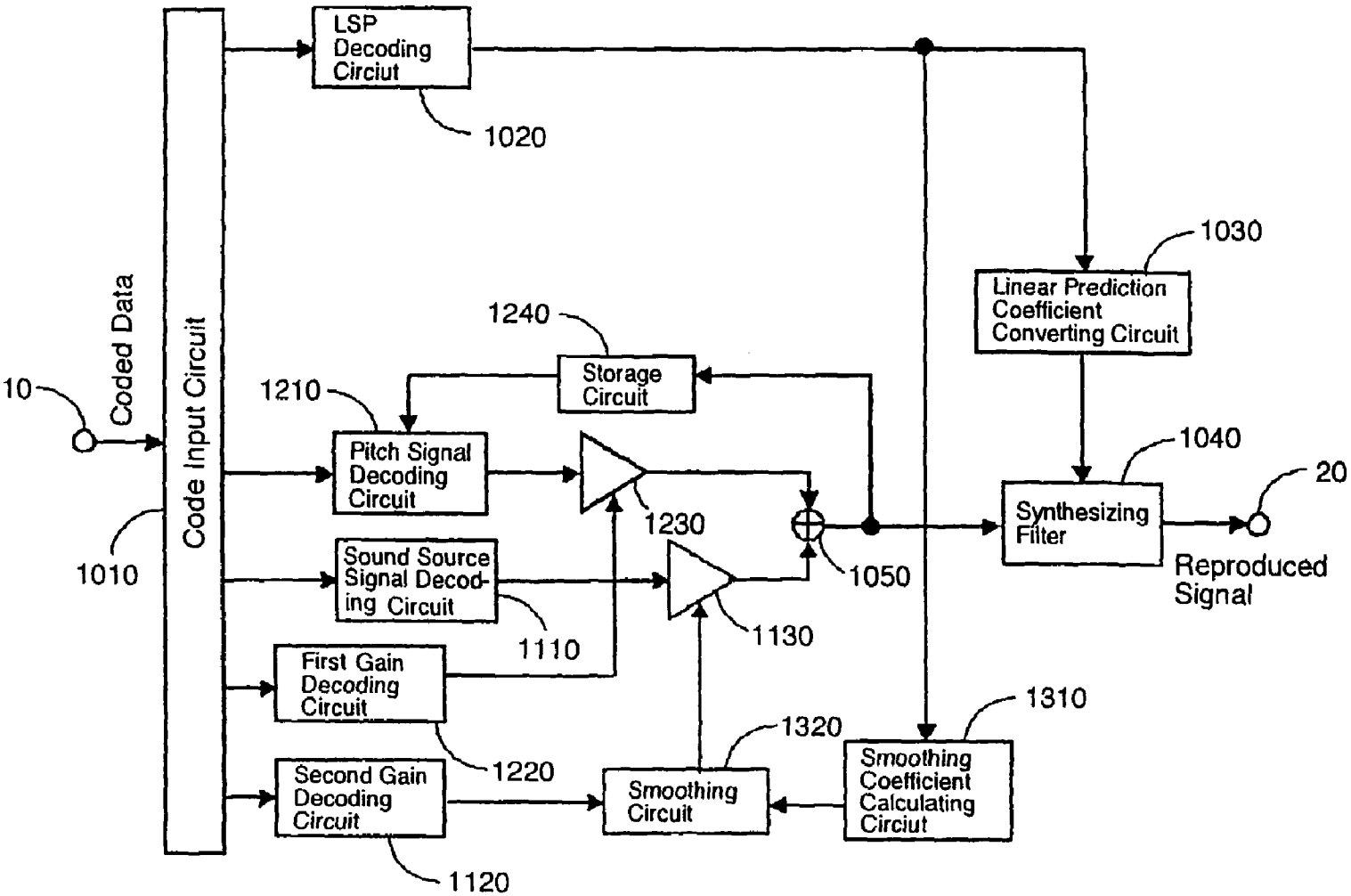
FIG. 1 (PRIOR ART)
FIG. 1 is a block diagram showing an example of a configuration of a conventional speech signal decoding apparatus.

The speech signal decoding apparatus shown in FIG. 5 differs from the conventional speech signal decoding apparatus shown in FIG. 1 in that excitation signal normalizing circuit 2510 and excitation signal restoring circuit 2610 are added and the connections are changed in the vicinity of them including adder 1050 and smoothing circuit 1320. Specifically, the output from adder 1050 is supplied only to excitation signal normalizing circuit 2510, and the output from second gain decoding circuit 1120 is directly supplied to second gain circuit 1130, the gain from excitation signal normalizing circuit 2510 is supplied to smoothing circuit 1320 instead of the output from second gain decoding circuit 1120, the shape vector from excitation signal normalizing circuit 2510 and the output from smoothing circuit 1320 are supplied to excitation signal restoring circuit 2610, and the output from excitation signal restoring circuit 2610 is supplied to synthesizing filter 1040 and to storage circuit 1240 instead of the output from adder 1050.

Excitation signal normalizing circuit 2510 calculates a norm of the excitation vector outputted from adder 1050 for each fixed period, and divides the excitation vector by the calculated norm. In this speech signal decoding apparatus, smoothing circuit 1320 smoothes a norm with a norm obtained in a previous period. Excitation signal restoring circuit 2610 multiplies the excitation vector by the smoothed norm to change the amplitude of the excitation vector in that period.

In FIG. 5, the functional blocks identical to those in FIG. 1 are designated the same reference numerals as those in FIG. 1. Specifically, since input terminal 10, output terminal 20, code input circuit 1010, LSP decoding circuit 1020, linear prediction coefficient converting circuit 1030, sound source signal decoding circuit 1110, storage circuit 1240, pitch signal decoding circuit 1210, first gain decoding circuit 1220, second gain decoding 1120, first gain circuit 1230, second gain circuit 1130, adder 1050, smoothing coefficient calculating circuit 1310 and synthesizing filter 1040 in FIG. 5 are the same as the counterparts in FIG. 1, the description thereof is not repeated here. Description is hereinafter made for excitation signal normalizing circuit 2510 and excitation signal restoring circuit 2610.

Assume herein, similarly to the case shown in FIG. 1, that bit sequences are inputted at a frame period of $T_{fr}$ (for example, 20 msec), and reproduced vectors are calculated at a period (subframe) of $T_{fr}/N_{sfr}$ (for example, 5 msec) where $N_{sfr}$ is an integer number (for example, 4). A frame length corresponds to $L_{fr}$ samples (for example, 320 samples), and a subframe length corresponds to $L_{sfr}$ samples (for example, 80 samples). These numbers are employed in the case of a sampling frequency of 16 kHz for input signals.

Excitation signal normalizing circuit 2510 receives, as its input, an excitation vector $[x_{exc}^{(m)}(i), i=0, \ldots, L_{sfr}-1, m=0, \ldots, N^{sfr}-1]$ in m-th subframe from adder 1050, calculates gain and a shape vector from the excitation vector $[x_{exc}^{(m)}(i)]$ for each subframe or for each subsubframe obtained by dividing a subframe, outputs the calculated gain to smoothing circuit 1320 and the shape vector to excitation signal restoring circuit 2610. As the gain, such a norm as represented with the following equation is used:

$$g_{exc}(m \cdot N_{ssfr} + l) = \sqrt{\sum_{n=0}^{L_{sfr}/N_{ssfr}-1} x_{exc}^{(m)}\left(l \cdot \frac{L_{sfr}}{N_{ssfr}} + n\right)^2}$$

$$m=0, \ldots, N^{sfr}-1, l=0, \ldots N_{ssfr}-1$$

where $N_{ssfr}$ is the number of division of a subframe (the number of subsubframes in a subframe) (for example, two). At this point, excitation signal normalizing circuit 2510 calculates the shape vector obtained by dividing the excitation vector $[x_{exc}^{(m)}(i)]$ by the gain $[g_{exc}(j), j=0, \ldots, (N_{sfr} \cdot N_{ssfr}-1)]$ with the following equation:

$$s_{exc}^{(m \cdot N_{ssrf}+l)}(i) = \frac{1}{g_{exc}(m \cdot N_{ssfr} + l)} \cdot x_{exc}^{(m)}\left(l \cdot \frac{L_{sfr}}{N_{ssfr}} + i\right)$$

$$i=0, \ldots, L_{sfr}/N_{ssfr}-1, l=0, \ldots, N_{ssfr}-1, m=0, \ldots, N_{sfr}-1$$

Excitation signal restoring circuit 2610 receives, as its input, the smoothed gain $[\bar{g}_{exc}(j), j=0, \ldots, (N_{sfr} \cdot N_{sfr}-1)]$ from smoothing circuit 1320 and the shape vector $[s_{(exc)}^{(m)}(i), i=0, \ldots, (L_{sfr}/N_{ssfr}-1), j=0, \ldots, (N_{sfr} \cdot N_{ssfr}-1)]$ from excitation signal normalizing circuit 2510, calculates a smoothed excitation vector with the following equation, and outputs the excitation vector to storage circuit 1240 and to synthesizing filter 1040:

$$\hat{x}_{exc}^{(m)}\left(l \cdot \frac{L_{sfr}}{N_{ssfr}} + i\right) = \bar{g}_{exc}(m \cdot N_{ssfr} + 1) \cdot s_{exc}^{(m \cdot N_{ssfr}+l)}(i)$$

$$i=0, \ldots, L_{sfr}/N_{ssfr}-1, l=0, \ldots, N_{ssfr}-1, m=0, \ldots, N_{sfr}-1$$

In the speech signal decoding apparatus shown in FIG. 5, adder 1050 adds a sound source vector after it is multiplied by gain to a pitch vector after it is multiplied by gain to produce an excitation vector. Excitation signal normalizing circuit 2510, smoothing circuit 1320 and excitation signal restoring circuit 2610 smooth the norm calculated from the excitation vector in a noise period. As a result, short time average power in the excitation vector is smoothed in terms of time to improve degradation of decoded sound quality in the noise period.

Figure 6:
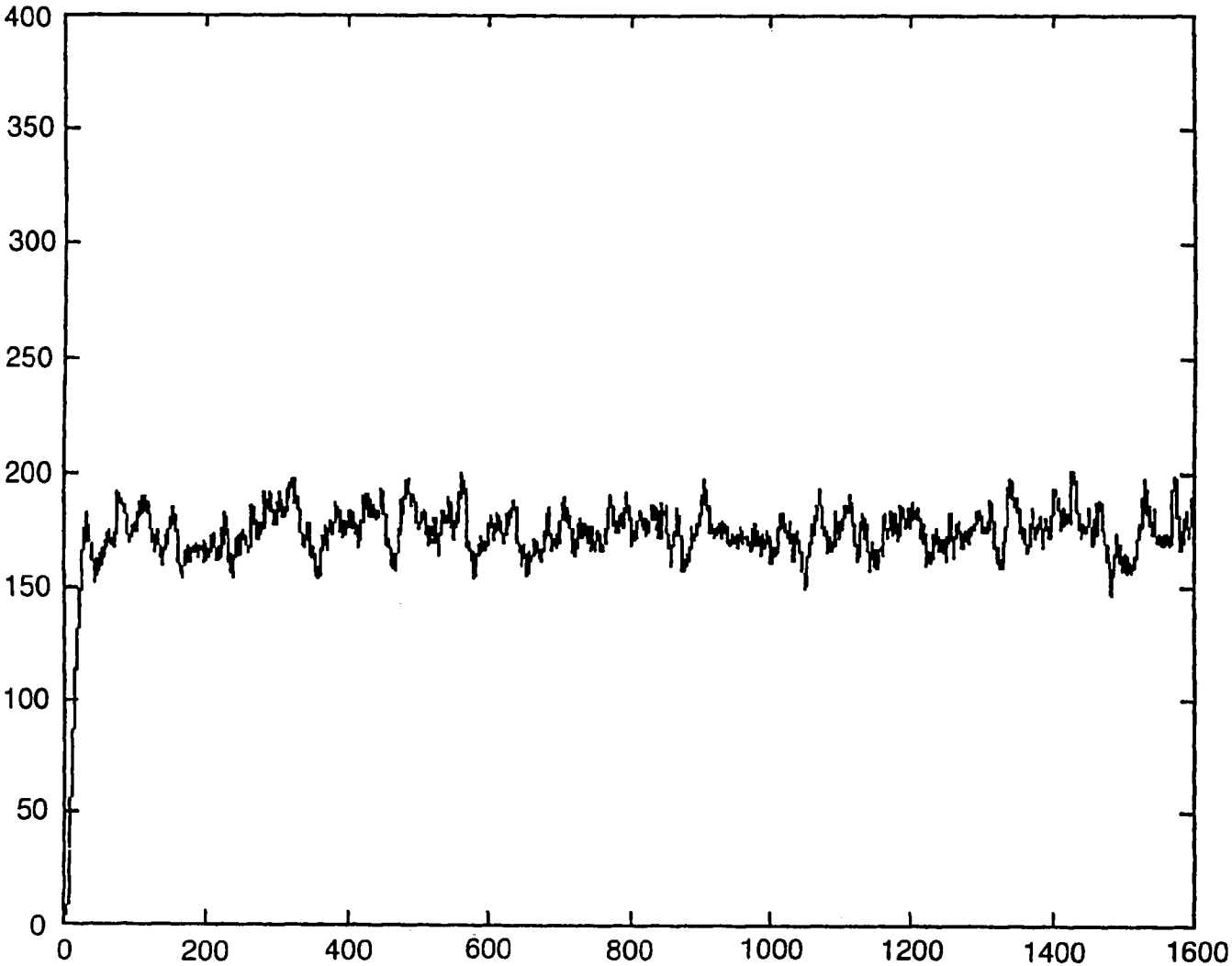
FIG. 6 is a graph representing short time average power of an excitation signal (excitation vector) for which smoothing was performed on a norm calculated from an excitation vector based on the present invention.

FIG. 6 shows short time average power of an excitation vector after smoothing for the norm calculated from the excitation vector in a noise period. The horizontal axis represents a frame number, while the vertical axis represents power. The short time average power is calculated for every 80 msec. It can be seen from FIG. 6 that the smoothing according to the embodiment causes smoothed short time average power in the excitation vector (excitation signal) in terms of time.

Figure 7:
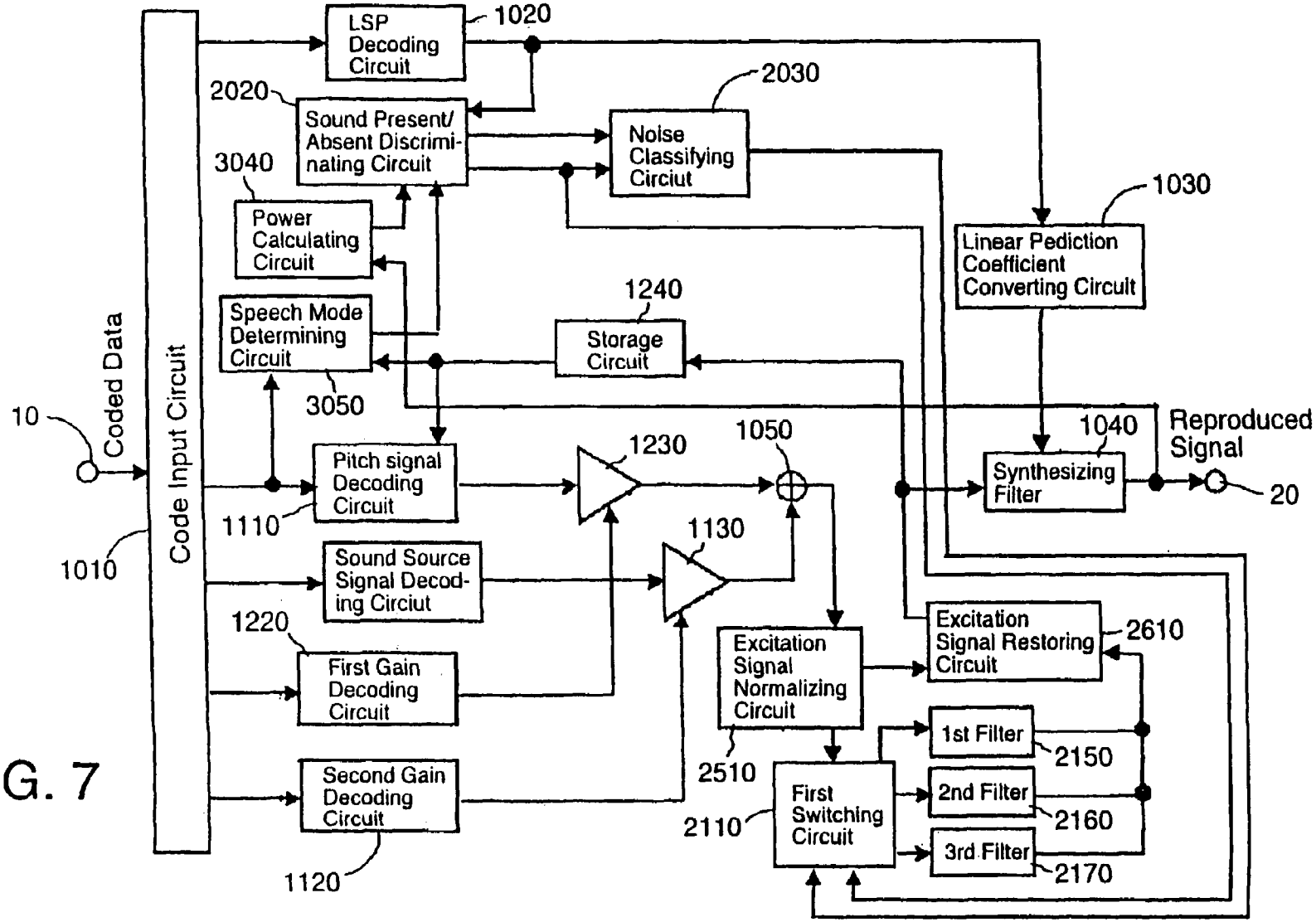
FIG. 7 is a block diagram showing a configuration of a speech signal decoding apparatus based on a second embodiment of the present invention.

FIG. 7 shows a speech signal decoding apparatus of a second embodiment of the present invention. The speech signal decoding apparatus shown in FIG. 7 differs from the speech signal decoding circuit shown in FIG. 5 in that first switching circuit 2110 and first to third filters 2150, 2160 and 2170 are provided instead of smoothing circuit 1320 for performing processing in accordance with the characteristic of an input signal, smoothing coefficient calculating circuit 1310 is eliminated, and sound present/absent discriminating circuit 2020 is provided for discriminating between a sound present period and a sound absent period, noise classifying circuit 2030 is provided for classifying noise, power calculating circuit 3040 is provided for calculating power of a reproduced vector, and speech mode determining circuit 3050 is provided for determining a speech mode $S_{mode}$, later described. Each of first to third filters 2150, 2160 and 2170 functions as a smoothing circuit, but the contents of their smoothing processing performed are different from one another.

The speech signal decoding apparatus shown in FIG. 7 also forms a pair with the conventional art speech signal coding apparatus shown in FIG. 2 to constitute a speech signal coding and decoding system, and is configured to receive coded data outputted from the speech signal coding apparatus shown in FIG. 2 to perform decoding of the coded data. In FIG. 7, the functional blocks identical to those in FIG. 5 are designated the same reference numerals as those in FIG. 5.

Description is hereinafter made for power calculating circuit 3040, speech mode determining circuit 3050, sound present/absent discriminating circuit 2020, noise classifying circuit 2030, first switching circuit 2110, first filter 2150, second filter 2160 and third filter 2170.

Power calculating circuit 3040 is supplied with a reproduced vector from synthesizing filter 1040, calculates power from sum of squares of the reproduced vectors, outputs the calculation result to sound present/absent discriminating circuit 2020. Assume herein that power is calculated for each subframe, and power in m-th subframe is calculated using a reproduced vector outputted from synthesizing filter 1040 in (m-1)th subframe. Assuming that the reproduced vector is $[S_{syn}(i), i=0, \ldots, L_{sfr}]$, power ($E_{pow}$) is calculated with the following equation:

$$E_{pow} = \frac{1}{L_{sfr}} \sum_{i=0}^{L_{sfr}-1} S_{syn}^2(i)$$

Instead of the above equation, for example, a norm for a reproduced vector represented by the following equation may be used:

$$E_{pow} = \sqrt{\sum_{i=0}^{L_{sfr}-1} S_{syn}^2(i)}$$

Speech mode determining circuit 3050 is supplied with a previous excitation vector $[e_{mem}(i), i=0, \ldots, (L_{mem}-1)]$ held in storage circuit 1240 and with an index from code input circuit 1010. This index specifies a delay $L_{pd}$. The $L_{mem}$ is a constant determined by the maximum value of the $L_{pd}$. In m-th subframe, speech mode determining circuit 3050 calculates a pitch prediction gain $[G_{emem}(m), m=1, \ldots, N_{sfr}]$ as follows, from the previous excitation vector $e_{mem}(i)$ and the delay $L_{pd}$:

$$G_{emem}(m) = 10 \log_{10} (g_{emem}(m)) \text{ where}$$

$$g_{emem}(m) = \frac{1}{1 - \frac{E_c^2(m)}{E_{a1(m)} E_{a2(m)}}}$$

$$E_{a1}(m) = \sum_{i=0}^{L_{sfr}-1} e_{mem}^2(i)$$

$$E_{a2}(m) = \sum_{i=0}^{L_{sfr}-1} e_{mem}^2(i - L_{pd})$$

$$E_c(m) = \sum_{i=0}^{L_{sfr}-1} e_{mem}(i) e_{mem}(i - L_{pd})$$

Speech mode determining circuit 3050 performs the following threshold value processing on the pitch prediction gain $G_{emem}(m)$, or an in-frame average value $\overline{G}_{emem}(n)$ in n-th frame for the $G_{emem}(m)$, thereby setting a speech mode $S_{mode}$:

if ($\overline{G}_{emem}(n) \geqq 3.5$) then $S_{mode}=2$
else $S_{mode}=0$

Speech mode determining circuit 3050 outputs the speech mode $S_{mode}$ to sound present/absent discriminating circuit 2020.

Sound present/absent discriminating circuit 2020 receives, as its inputs, the LSP: $q_j^{(m)}(n)$ outputted from LSP decoding circuit 1020, the speech mode $S_{mode}$ outputted from speech mode determining circuit 3050, and the power outputted from power calculating circuit 3040. The procedure for deriving the amount of variations in spectrum parameter in sound present/absent discriminating circuit 2020 is given below. The LSP: $q_j^{(m)}(n)$ is used herein as the spectrum parameter. In n-th frame, a long time average $q_j(n)$ of the LSP is calculated with the following equation:

$$\overline{q}_j(n) = \beta_0 \cdot \overline{q}_j(n-1) + (1-\beta_0) \cdot \hat{q}_j^{(N_{sfr})}(n)$$

$$j=1, \ldots, N_p$$

where $\beta_0=0.9$. A variation amount $d_q(n)$ of the LSP in n-th frame is defined with the following equation:

$$d_q(n) = \sum_{j=1}^{N_p} \sum_{m=1}^{N_{sfr}} \frac{D_{q,j}^{(m)}(n)}{\overline{q}_j(n)}$$

where $D_{q,j}^{(m)}(n)$ corresponds to the distance between $\overline{q}_j(n)$ and $\hat{q}_j^{(m)}(n)$. For example, one of the following equations may be used:

$$D_{q,j}^{(m)}(n) = \left(\overline{q}_j(n) - \hat{q}_j^{(m)}(n)\right)^2$$

or $$D_{q,j}^{(m)}(n) = \left|\overline{q}_j(n) - \hat{q}_j^{(m)}(n)\right|$$

The latter is used in this case. Generally, a period with a large variation amount $d_q(n)$ corresponds to a sound present period, while a period with a small variation amount $d_q(n)$ corresponds to a sound absent period (noise period). However, there is a problem that a threshold value for discriminating between the sound present period and sound absent period is not easily set since the variation amount exerts large variations with time and the range of values of variation amounts in the sound present period overlaps with the range of values of variation amounts in the sound absent period. Thus, the long time average of the variation amount $d_q(n)$ is used for discrimination between the sound present period and sound absent period. A long time average $\overline{d}_{q1}(n)$ is derived using a linear filter or a non-linear filter. The average value, median value, mode of the variation amount $d_q(n)$ or the like can be applied thereto, for example. In this case, the following equation is used:

$$\overline{d}_{q1}(n) = \beta_1 \cdot \overline{d}_{q1}(n-1) + (1-\beta_1) \cdot d_q(n)$$

where $\beta_1=0.9$.

With threshold processing for the average value, a discrimination flag $S_{vs}$ is determined as follows:

if ($\overline{d}_{q1}(n) \geqq c_{th1}$) then $S_{vs}=1$
else $S_{vs}=0$ where $C_{th1}$ is a constant (for example, 2.2), and $S_{vs}=1$ corresponds to a sound present period, while $S_{vs}=0$ corresponds to a sound absent period. Since a period with high constancy has a small $S_{vs}$ even in the sound present period, it may be erroneously considered as a sound absent period. Thus, when a frame has large power and pitch prediction gain is large in a period, the period should be considered as a sound present period. At this point, the $S_{vs}$ is modified by the following additional determination:

if ($\hat{E}_{rms} \geqq C_{rms}$ and $S_{mode} \geqq 2$) then $S_{vs}=1$
else $S_{vs}=0$ where $C_{rms}$ is a certain constant (for example, 10000). $S_{mode} \geqq 2$ corresponds to the in-frame average value $\overline{G}_{op}(n)$ of the pitch prediction gain equal to or higher than 3.5 dB. Sound present/absent discriminating circuit 2020 outputs the discrimination flag $S_{vs}$ to noise classifying circuit 2030 and to first switching circuit 2110, and outputs $\overline{d}_{q1}(n)$ to noise classifying circuit 2030.

Noise classifying circuit 2030 receives, as its input, $\overline{d}_{q1}(n)$ and the discrimination flag $S_{vs}$ outputted from sound present/absent discriminating circuit 2020. In a sound absent period (noise period), a linear filter or a non-linear filter is used to derive a value $\overline{d}_{q2}(n)$ which reflects average behaviors of $\overline{d}_{q1}(n)$. When the $S_{vs}=0$, the following equation is calculated:

$$\overline{d}_{q2}(n)=\beta_2\cdot\overline{d}_{q2}(n-1)+(1-\beta_2)\cdot\overline{d}_{q1}(n)$$

where $\beta_2=094$.

With threshold processing for $\overline{d}_{q2}(n)$, noise is classified, and a classification flag $S_{vs}$ is determined as follows:

if $(\overline{d}_{q2}(n) \geqq c_{th2})$ then $S_{nz}=1$ else $S_{nz}=0$ where $C_{th2}$ is a certain constant (for example, 1.7), and $S_{nz}=1$ corresponds to noise having a frequency characteristic inconstantly changing with time, while $S_{nz=0}$ corresponds to noise having a frequency characteristic constantly changing with time. Noise classifying circuit 2030 outputs the $S_{nz}$ to first switching circuit 2110.

First switching circuit 2110 receives, as its inputs, the gain $[g_{exc}(j), j=0, \ldots, (N_{ssfr}\cdot N_{sfr}-1)]$ outputted from excitation signal normalizing circuit 2510, the discrimination flag $S_{vs}$ from sound present/absent discriminating circuit 2020, and the classification flag $S_{nz}$ from noise classifying circuit 2030. First switching circuit 2110 switches a switch in accordance with the value of the discrimination flag and the value of the classification flag, thereby outputting the gain $g_{exc}(j)$ to first filter 2150 if $S_{vs}=S_{nz}=0$, to second filter 2160 if $S_{vs}=0$ and $S_{nz}=1$, or to third filter 2170 if $S_{vs}=1$.

First filter 2150 receives, as its input, the gain $[g_{exc}(i), j=0, \ldots, (N_{ssfr}\cdot N_{sfr}-1)]$ from first switching circuit 2110, smoothes it with a linear filter or a non-linear filter to produce a first smoothed gain $g_{exc,1}(j)$, and outputs it to excitation signal restoring circuit 2610. In this case, the filter represented by the following equation is used:

$$\overline{g}_{exc,1}(n)=\gamma_{21}\cdot\overline{g}_{exc,1}(n-1)+(1-\gamma_{21})\cdot g_{exc}(n)$$

where $\overline{g}_{exc,1}(-1)$ corresponds to $\overline{g}_{exc,1}(N_{ssfr}\cdot N_{sfr}-1)$ in the previous frame. Also, $\gamma_{21}=0.94$.

Second filter 2160 smoothes the gain outputted from first switching circuit 2110 using a linear filter or a non-linear filter to produce a second smoothed gain $\overline{g}_{exc,2}(j)$ which is then outputted to excitation signal restoring circuit 2160. In this case, the filter represented by the following equation is used:

$$\overline{g}\mathrm{exc},\mathbf{2}(n)=\gamma_{22}\cdot\overline{g}_{exc,2}(n-1)+(1-\gamma_{22})\cdot g_{exc}(n)$$

where $\overline{g}_{exc,2}(—1)$ corresponds to $\overline{g}_{exc,2}(N_{ssfr}\cdot N_{sfr}-1)$ in the previous frame. Also, $\gamma_{22}=0.9$.

Third filter 2170 receives, as its input, the gain outputted from first switching circuit 2110, smoothes it with a linear filter or a non-linear filter to produce a third smoothed gain $\overline{g}_{exc,3}(n)$ and outputs it to excitation signal restoring circuit 2160. In this case, $\overline{g}_{exc,3}(n)=g_{exc}(n)$.

As described above, in the speech signal decoding apparatus shown in FIG. 7, first filter 2150, second filter 2160 and third filter 2170 can perform different smoothing processing, and power calculating circuit 3040, speech mode determining circuit 3050, sound present/sound absent discriminating circuit 2020 and noise classifying circuit 2030 can identify the nature of an input signal. The switching of the filters in accordance with the identified nature of the input signal enables smoothing processing of the excitation signal to be performed in consideration of the characteristics of the input signal. As a result, optimal processing is selected according to background noise to allow further improvement in degradation of decoded sound quality in a noise period.

Figure 8:
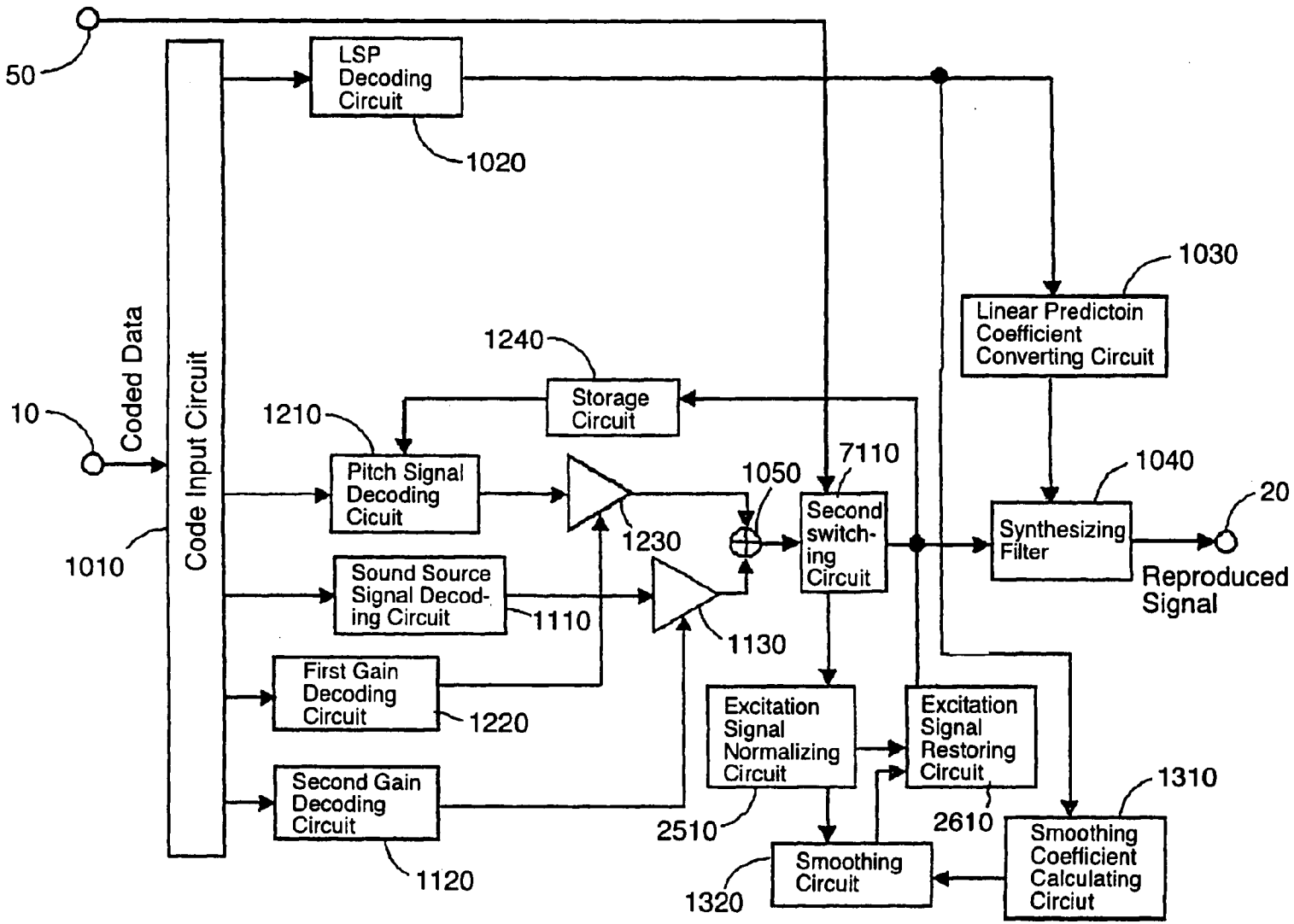
FIG. 8 is a block diagram showing a configuration of a speech signal decoding apparatus based on a third embodiment of the present invention.

FIG. 8 shows a speech signal decoding apparatus of a third embodiment of the present invention. The speech signal decoding apparatus shown in FIG. 8 differs from the speech signal decoding apparatus shown in FIG. 5 in that input terminal 50 and second switching circuit 7110 are added and the connections are changed. The speech signal decoding apparatus shown in FIG. 8 also forms a pair with the conventional speech signal coding apparatus shown in FIG. 2 to constitute a speech signal coding and decoding system, and is configured to receive coded data outputted from the speech signal coding apparatus shown in FIG. 2 to perform decoding the coded data. In FIG. 8, the functional blocks identical to those in FIG. 5 are designated the same reference numerals as those in FIG. 5.

A switching control signal is supplied from input terminal 50. Second switching circuit 7110 receives an excitation vector outputted from adder 1050, and outputs the excitation vector to synthesizing filter 1040 or to excitation signal normalizing circuit 2510 in accordance with the switching control signal. Therefore, the speech signal decoding apparatus can select whether the amplitude of the excitation vector is changed or not in accordance with the switching control signal.

Figure 9:
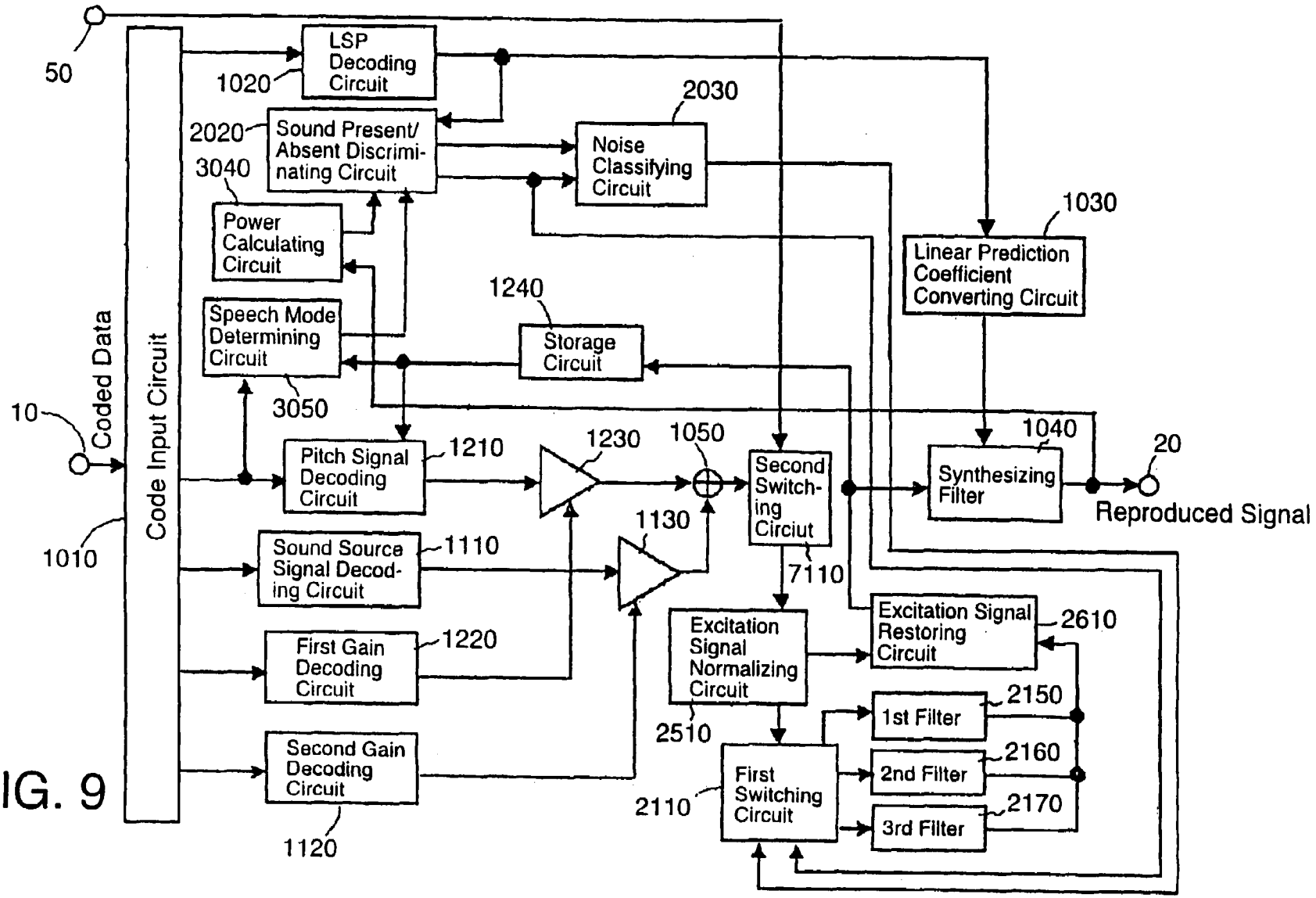
FIG. 9 is a block diagram showing a configuration of a speech signal decoding apparatus based on a fourth embodiment of the present invention.

FIG. 9 shows a speech signal decoding apparatus of a fourth embodiment of the present invention. The speech signal decoding apparatus differs from the speech signal decoding apparatus shown in FIG. 7 in that input terminal 50 and second switching circuit 7110 are added and the connections are changed. The speech signal decoding apparatus shown in FIG. 9 also forms a pair with the conventional speech signal coding apparatus shown in FIG. 2 to constitute a speech signal coding and decoding system, and is configured to receive coded data outputted from the speech signal coding apparatus shown in FIG. 2 to perform decoding the coded data. In FIG. 9, the functional blocks identical to those in FIG. 7 are designated the same reference numerals as those in FIG. 7.

A switching control signal is supplied from input terminal 50. Second switching circuit 7110 receives an excitation vector outputted from adder 1050, and outputs the excitation vector to synthesizing filter 1040 or to excitation signal normalizing circuit 2510 in accordance with the switching control signal. Therefore, the speech signal decoding apparatus can select whether the amplitude of the excitation vector is changed or not in accordance with the switching control signal, and if the amplitude of the excitation vector is to be changed, smoothing processing can be switched in accordance with the characteristic of the input signal.

While preferred embodiments of the present invention have been described using specific terms, such description is for illustrative purposes only, and it is to be understood that changes and variations may be made without departing from the spirit or scope of the following claims.

What is claimed is:

1. A method of decoding a speech signal by decoding information on an excitation signal and information on a linear prediction coefficient from a received signal, producing said excitation signal and said linear prediction coefficient from said decoded information, and driving a filter configured with said linear prediction coefficient by said excitation signal, said method comprising the steps of:

calculating a norm of said excitation signal for each fixed period;

smoothing said calculated norm using a norm obtained in a previous period;

changing amplitude of said excitation signal in said period using said calculated norm and said smoothed norm; and driving said filter by said excitation signal with the changed amplitude wherein the amplitude of said excitation signal is changed by dividing said excitation signal in said period by said norm, and multiplying said excitation signal by said smoothed norm in said period.

2. The method of decoding a speech signal according to claim 1, wherein said excitation signal is an excitation vector.

3. The method of decoding a speech signal according to claim 1, wherein said excitation signal with the changed amplitude is switched to and from the excitation signal with an unchanged amplitude in accordance with an inputted switching signal, and said filter is driven by the switched excitation signal.

4. The method of decoding a speech signal according to claim 1, wherein said received signal is a signal coded by representing an input speech signal with an excitation signal and a linear prediction coefficient.

5. The method of decoding a speech signal according to claim 1, further comprising the step of discriminating between a sound present period and a noise period for said received signal using said decoded information, and wherein the said calculating step, said smoothing step, said changing step and said driving step are performed in said noise period.

6. The method of decoding a speech signal according to claim 5, wherein said excitation signal is an excitation vector.

7. The method of decoding a speech signal according to claim 5, wherein the amplitude of said excitation signal is changed by dividing said excitation signal in said period by said norm, and multiplying said excitation signal by said smoothed norm in said period.

8. The method of decoding a speech signal according to claim 7, wherein said excitation signal with the changed amplitude is switched to and from the excitation signal with an unchanged amplitude in accordance with an inputted switching signal, and said filter is driven by the switched excitation signal.

9. The method of decoding a speech signal according to claim 5, wherein nature of said received signal in said noise period is identified based on said decoded information, and processing contents at the said smoothing step are selected based on said identified nature.

10. The method of decoding a speech signal according to claim 5, wherein said received signal is a signal coded by representing an input speech signal with an excitation signal and a linear prediction coefficient.

11. An apparatus for decoding a speech signal by decoding information on an excitation signal and information on a linear prediction coefficient from a received signal, producing said excitation signal and said linear prediction coefficient from said decoded information, and driving a filter configured with said linear prediction coefficient by said excitation signal, said apparatus comprising:

an excitation signal normalizing circuit for calculating a norm of said excitation signal for each fixed period and dividing said excitation signal by said norm;

a smoothing circuit for smoothing said norm using a norm obtained in a previous period; and an excitation signal restoring circuit for multiplying said excitation signal by said smoothed norm to change amplitude of said excitation signal in said period.

12. The apparatus of decoding a speech signal according to claim 11, wherein said excitation signal is an excitation vector.

13. The apparatus of decoding a speech signal according to claim 11, further comprising a sound present/absent discriminating circuit for discriminating between a sound present period and a noise period for said received signal using said decoded information, and wherein the amplitude of said excitation signal is changed in said noise period.

14. The apparatus of decoding a speech signal according to claim 13, further comprising a noise classifying circuit for identifying nature of said received signal in said noise period using said decoded information, and wherein said smoothing circuit includes a plurality of smoothing filters with characteristics different from one another, and one of said smoothing filters is selected in accordance with said identified nature.

15. The apparatus of decoding a speech signal according to claim 14, wherein said excitation signal is an excitation vector.

16. The apparatus of decoding a speech signal according to claim 14, wherein said received signal is a signal coded by representing an input speech signal with an excitation signal and a linear prediction coefficient.

17. The apparatus of decoding a speech signal according to claim 11, further comprising a switching circuit for providing said excitation signal produced from said decoded information to one of said excitation signal normalizing circuit and said filter in accordance with an inputted switching signal.

18. The apparatus of decoding a speech signal according to claim 11, wherein said received signal is a signal coded by representing an input speech signal with an excitation signal and a linear prediction coefficient.

19. A method of decoding a speech signal by decoding information on an excitation signal and information on a linear prediction coefficient from a received signal, producing said excitation signal and said linear prediction coefficient from said decoded information, and driving a filter configured with said linear prediction coefficient by said excitation signal, said method comprising:

calculating a norm of said excitation signal for each fixed period;

smoothing said calculated norm using a norm obtained in a previous period;

changing amplitude of said excitation signal in said period using a ratio of said calculated norm and said smoothed norm; and driving said filter by said excitation signal with the changed amplitude wherein temporal fluctuation of said excitation signal is reduced.

20. An apparatus for decoding a speech signal by decoding information on an excitation signal and information on a linear prediction coefficient from a received signal, producing said excitation signal and said linear prediction coefficient from said decoded information, and driving a filter configured with said linear prediction coefficient by said excitation signal, said apparatus comprising:

an excitation signal normalizing circuit for calculating a norm of said excitation signal for each fixed period;

a smoothing circuit for smoothing said norm using a norm obtained in a previous period; and an excitation signal restoring circuit for changing amplitude of said excitation signal in said period, wherein said amplitude is changed based on a ratio of said calculated norm and said smoothed norm.

* * * * *